US011084045B2

(12) United States Patent
Ribeiro

(10) Patent No.: US 11,084,045 B2
(45) Date of Patent: Aug. 10, 2021

(54) MAGNETIC MATRIX FOR HIGH INTENSITY MAGNETIC SEPARATOR

(71) Applicant: Jose Pancracio Ribeiro, Belo Horizonte-MG (BR)

(72) Inventor: Jose Pancracio Ribeiro, Belo Horizonte-MG (BR)

(73) Assignee: Jose Pancracio Ribeiro, Belo Horizonte-MG (BR)

( * ) Notice: Subject to any disclaimer, the term of this patent is extended or adjusted under 35 U.S.C. 154(b) by 0 days.

(21) Appl. No.: 16/337,069

(22) PCT Filed: Sep. 28, 2017

(86) PCT No.: PCT/BR2017/050286

§ 371 (c)(1),
(2) Date: Mar. 27, 2019

(87) PCT Pub. No.: WO2018/058222

PCT Pub. Date: Apr. 5, 2018

(65) Prior Publication Data

US 2020/0030817 A1 Jan. 30, 2020

(30) Foreign Application Priority Data

Sep. 28, 2016 (BR) ..... 102016022548-5

(51) Int. Cl.
*B03C 1/034* (2006.01)
*B03C 1/032* (2006.01)

(52) U.S. Cl.
CPC ..... *B03C 1/034* (2013.01); *B03C 1/032* (2013.01); *B03C 2201/18* (2013.01)

(58) Field of Classification Search
CPC ..... B03C 1/032; B03C 1/034; B01D 35/06
See application file for complete search history.

(56) References Cited

U.S. PATENT DOCUMENTS 3,912,634 A * 10/1975 Howell ..... B01D 35/06 210/222
4,737,294 A * 4/1988 Kukuck ..... B03C 1/03 209/214

(Continued)

FOREIGN PATENT DOCUMENTS

DE 3744167 7/1989
GB 1559338 1/1980

(Continued)

OTHER PUBLICATIONS

Written Opinion for International (PCT) Patent Application No. PCT/BR2017/050286, dated Feb. 5, 2018, 8 pages.

(Continued)

*Primary Examiner* — Bradley R Spies
(74) *Attorney, Agent, or Firm* — Sheridan Ross PC

(57) ABSTRACT

The invention relates to a magnetic matrix for high intensity magnetic separator which is fed with a pulp containing magnetic and non-magnetic particles, the magnetic matrix (8) comprising a series of grooved metal plates (7) on both sides thereof, the grooved plates being arranged in rows parallel to and spaced apart from each other from the same spacing (6) within a housing, each face of each metal grooved plate (7) having the ridges aligned with the valleys of the face facing it of the grooved plate (7), and a corrugated expanded sheet (12) is disposed at each spacing (6) between adjacent grooved plates (7), with corrugations of the corrugated expanded sheets (12) accompanying the ridge-valley alignments of the respective grooved plates (7).

6 Claims, 5 Drawing Sheets

(56) References Cited

U.S. PATENT DOCUMENTS

| | | | | |
|---|---|---|---|---|
| 4,874,508 | A * | 10/1989 | Fritz | B03C 1/03 209/214 |
| 6,241,894 | B1 * | 6/2001 | Briggs | B03C 1/035 210/222 |
| 2016/0151788 | A1 | 6/2016 | Oki et al. | |

FOREIGN PATENT DOCUMENTS

| | | |
|---|---|---|
| GB | 1576071 | 10/1980 |
| SU | 1593701 | 9/1990 |

OTHER PUBLICATIONS

International Search Report prepared by the European Patent Office dated Jan. 24, 2018, for International Application No. PCT/BR2017/050286.

* cited by examiner

MAGNETIC MATRIX FOR HIGH INTENSITY MAGNETIC SEPARATOR

CROSS REFERENCE TO RELATED APPLICATIONS

This application is a national stage application under 35 U.S.C. 371 and claims the benefit of PCT Application No. PCT/BR2017/050286 having an international filing date of 28 Sep. 2017, which designated the United States, which PCT application claimed the benefit of Brazil Patent Application No. BR102016022548-5 filed 28 Sep. 2016, the disclosure of each of which are incorporated herein by reference.

The invention relates to a magnetic matrix for high intensity magnetic separator WHIMS used in the recovery of ultrafine ore particles, which substantially reduces the amount of tailings generated in the mining process, thus reducing environmental impacts due to its storage in dams and also providing a greater use of natural resources.

DESCRIPTION OF THE PRIOR ART

In the mining process, ore in the form as it is mined is mixed with impurities. This ore must be purified in order to increase the content and increase its added value. Before being purified, the ore is sifted with water and is transformed into a pulp, which is then fed to the magnetic matrices of separators.

Magnetic separators used in the magnetic concentration process are already known in the art for separating the magnetic particles mixed in the pulp, obtaining a product of good quality. These separators combine efficiency and practicality, being used in the separation of fines from magnetic ores and non-magnetic ores.

Examples of magnetic separators are described in U.S. Pat. No. 3,830,367 and CA 717,830. In the inside of these magnetic separators are arranged magnetic matrices consisting of magnetizable steel grooved plates, provided with longitudinal grooves along their entire surface, on both faces. Each die has several plates arranged vertically and parallel to each other face to face, forming channels between the grooves of neighboring plates, which are traversed by the ore pulp. The grooves have the shape of triangles, whose external vertices concentrate the lines of force and generate the high magnetic field. The grooved plates are spaced from each other by spacers, which maintain the vertices of the triangles of the opposing plate grooves by a defined distance. This space between the opposing vertices defines the opening of the matrix, in mm, through which passes the pulp ore to be separated, and in the technical language of the high intensity magnetic separation is called "Gap".

The Gap, or spacing between the grooved plates, defines the space of air through which the force lines of the magnetic field must pass and is therefore a fundamental factor to be defined to carry out the process of magnetic separation, since, among other factors, the intensity of the magnetic field that can be generated depends on it. The gap also defines the maximum particle size of the mineral that can pass through the matrix. Gaps are typically available in some typical dimensions such as 1.5 mm; 2.0 mm; 2.5 mm; 3.0 mm; 3.2 mm; 3.8 mm; which can assume intermediate dimensions and sometimes up to 5.0 mm.

These matrices are mounted on the periphery of steel rotors and are magnetized by induction when the rotors rotate and pass in front of the magnetic poles of the separators. Due to the pole-induced magnetic field, the magnetizable particles of the ore pulp dumped onto the magnetic matrices are attracted and trapped in the plates of these matrices, while the tailings containing non-magnetic particles cross the channels formed between the grooves and are diverted to an outlet of tailings.

Nowadays, high intensity magnetic separation (WHIMS) technologies require that the separation be done in very narrow channels or openings as a condition for producing high intensity and high magnetic gradients. The impoverishment of mineral reserves and the reuse of waste have increased the demand for increasingly finer minerals and require increasingly higher magnetic fields and gradients, thus increasingly entailing a reduction in magnetic matrix openings through which particles must pass to be separated.

In known magnetic separators, which use matrices with grooved plates, the maximum magnetic field intensity has a limit of around 15,000 Gauss obtained with the use of 1.5 mm Gap. This limitation of field intensity impairs the magnetic separation of some ore particles contained in the pulp that only generate products in magnetic fields above 15,000 Gauss due to the ultrafine granulometry and its low magnetic susceptibility. Consequently, these magnetic particles that have commercial value end up being stored in tailings dams, causing impacts to the environment.

In order to increase this magnetic field it has already been tried to introduce flattened expanded steel sheets between the grooved plates. This experiment increased the magnetic field intensity of the matrices, but this solution improved the performance of the high-intensity magnetic separators in a limited way and for this reason there is no record of its application in practical cases.

The difficulties faced were due to the fact that, for practical reasons, conventional commercially available matrices were used whose grooved plates are ridge-ridge mounted, and this forced the use of flattened expanded steel sheets or plates. These flattened expanded steel sheets, as already mentioned, by not filling the valleys of the grooves, have the length of the collecting edges limited to the width of the matrix. However, due to the alignment of the ridges of adjacent grooved plates, it is only possible to use flattened steel sheets.

In addition, such flattened expanded sheets, by not entering the grooves of the grooved plates, when removed, do not enable cleaning the grooves through the scraping effect of the grooves. Therefore, these flattened sheets do not solve the problem relating to the difficulty of cleaning the grooved plates and the risk of matrix clogging.

Thus, the state of the art as described above presents many limitations for the recovery of ultrafine particles, among which the main ones are:

1. The limitation of the magnetic field and gradient to values that are insufficient to attract and separate the microparticles;

2. The free and unimpeded passage of the pulp through channels formed by the grooves of the matrices, allowing the pulp to pass at a very high speed and therefore greatly reducing the time available for the microparticles to be captured;

3. The limited availability of collecting edges in the grooved plates whose length is limited only to the length of the ridge of the grooves.

Several matrix models have been developed over the last 50 years, using metallic spheres, steel sponges, and finally flattened expanded steel sheets placed between the grooved plates, in an attempt to solve these problems, but with limited success, the main problem remaining, which is the difficulty of cleaning the matrices in case of clogging, which paralyzes production.

OBJECTS OF THE INVENTION

The object of the invention is to enable magnetic separators to operate with magnetic field intensity of up to 18,000 Gauss and gradients up to 4000 Gauss/mm increasing the amount and variety of magnetic particles which are extracted and recovered from the ore pulp, allowing the extraction of particles with lower particle size and lower magnetic susceptibility.

Another object of the invention is to provide a matrix for the magnetic separator which is easy to clean and which reduces the risk of clogging of the separator, and the consequent interruption of the operation of the plant where the magnetic separator is installed.

The present invention also aims to reduce the amount of mineral residues and tailings stored in dams, and reduce the waste of water in the mining process.

Another object of the invention is to maximize the quantity and quality of the material with commercial value extracted from the ore, thus raising the value of this raw material.

The present invention also aims to improve the performance of magnetic separators by increasing the amount and variety of magnetic particles that are extracted and recovered from the ore pulp, allowing the extraction of particles with lower particle size and lower magnetic susceptibility.

BRIEF DESCRIPTION OF THE INVENTION

The problems of the prior art are solved by a magnetic matrix for high intensity magnetic separator which is fed with a pulp containing magnetic and non-magnetic particles, the magnetic matrix comprising a series of metal plates grooved on two faces, the grooved plates being arranged parallel to and spaced from each other of a same spacing within a housing, each face of each metal grooved plate having the ridges aligned with the valleys of the face facing it of the adjacent metal grooved plate.

A corrugated expanded sheet is disposed at each spacing between adjacent grooved plates with the corrugations of the corrugated expanded sheets accompanying the ridge-valley alignments of the respective adjacent grooved plates.

The magnetic matrix may comprise corrugated expanded sheets of different heights, the height of which is less than or equal to the height of the grooved plate. The height of each corrugated expanded sheet is selected as a function of at least one of the hydraulic load, the pulp flow rate, and the residence time of the pulp within the matrix. Each corrugated expanded sheet has a handle at its upper end.

This configuration allows expanded steel sheets with corrugated profile to be perfectly inserted into the space between the grooved plates.

BRIEF DESCRIPTION OF THE DRAWINGS

The drawings attached hereto illustrate.

DETAILED DESCRIPTION OF THE DRAWINGS

Figures 1, 1A, 1B:
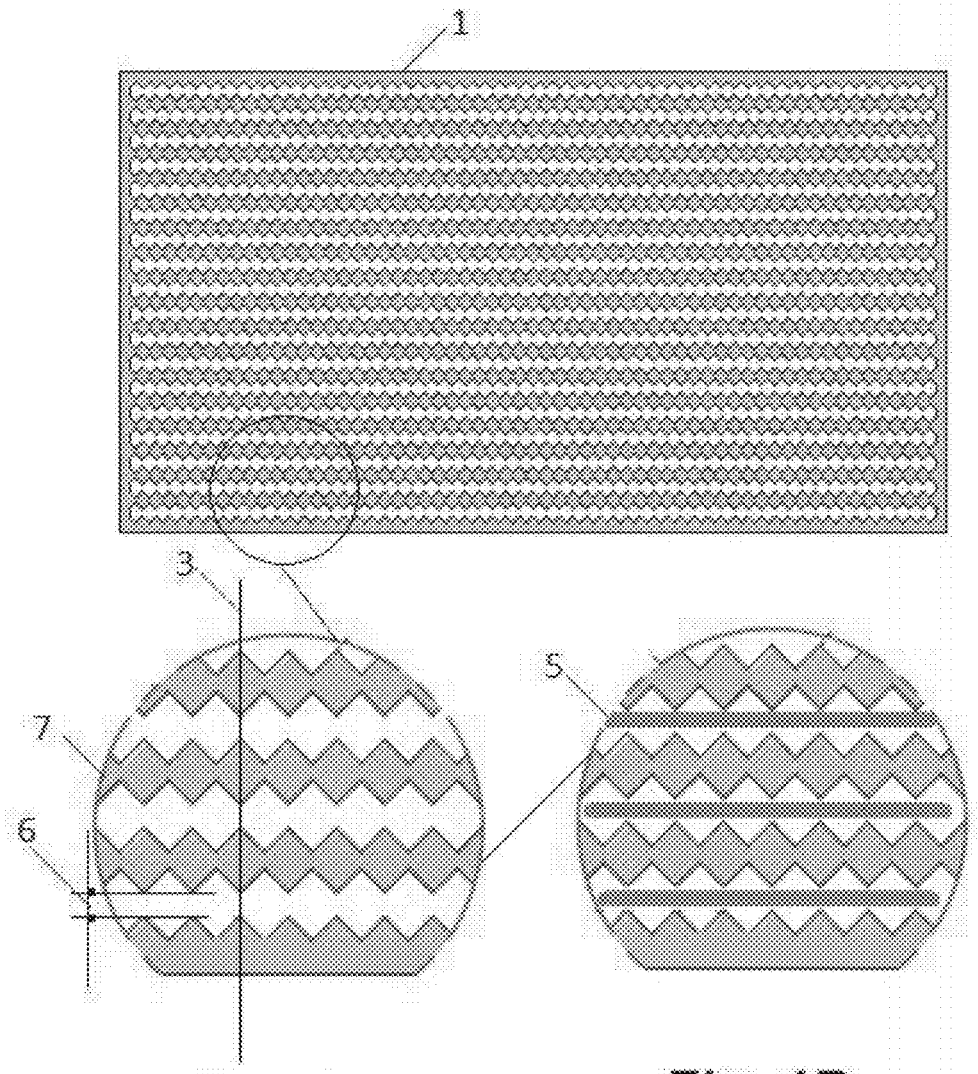
Fig. 1 (Prior Art)
Fig. 1A (Prior Art)
Fig. 1B (Prior Art)
FIG. 1—a front view of a magnetic matrix according to the state of the art, using ridge-to-ridge aligned grooved plates.
FIG. 1A—an enlarged detail view of a magnetic matrix of FIG. 1.
FIG. 1B—an enlarged detail view of the magnetic matrix of FIG. 1 with a flattened expanded sheet disposed between the plates.

This invention may be better understood through FIGS. 1 to 5. FIG. 1 shows a conventional magnetic matrix 1, which is the current market standard, and which can best be seen in detail from FIG. 1A. In magnetic matrices of high intensity magnetic separators (WHIMS), the grooved plates 7 are arranged with the ridges of adjacent plates perfectly aligned along line 3. The spacing 6 between the grooved plates 7 is indicated by the distance indicated by reference 6 existing between the ridges of the adjacent grooved plates 7. This spacing 6 is named simply as "GAP" in magnetic separation technology.

FIG. 1B shows in enlarged detail a version of the magnetic matrix with flattened expanded sheet 5 arranged between the grooved plates. It is noted that the ridge-ridge alignment of the grooved plates does not allow sufficient space between two grooved plates to engage a corrugated sheet therebetween, which completely fills the grooves of the plates.

Figures 2, 2A, 2B:
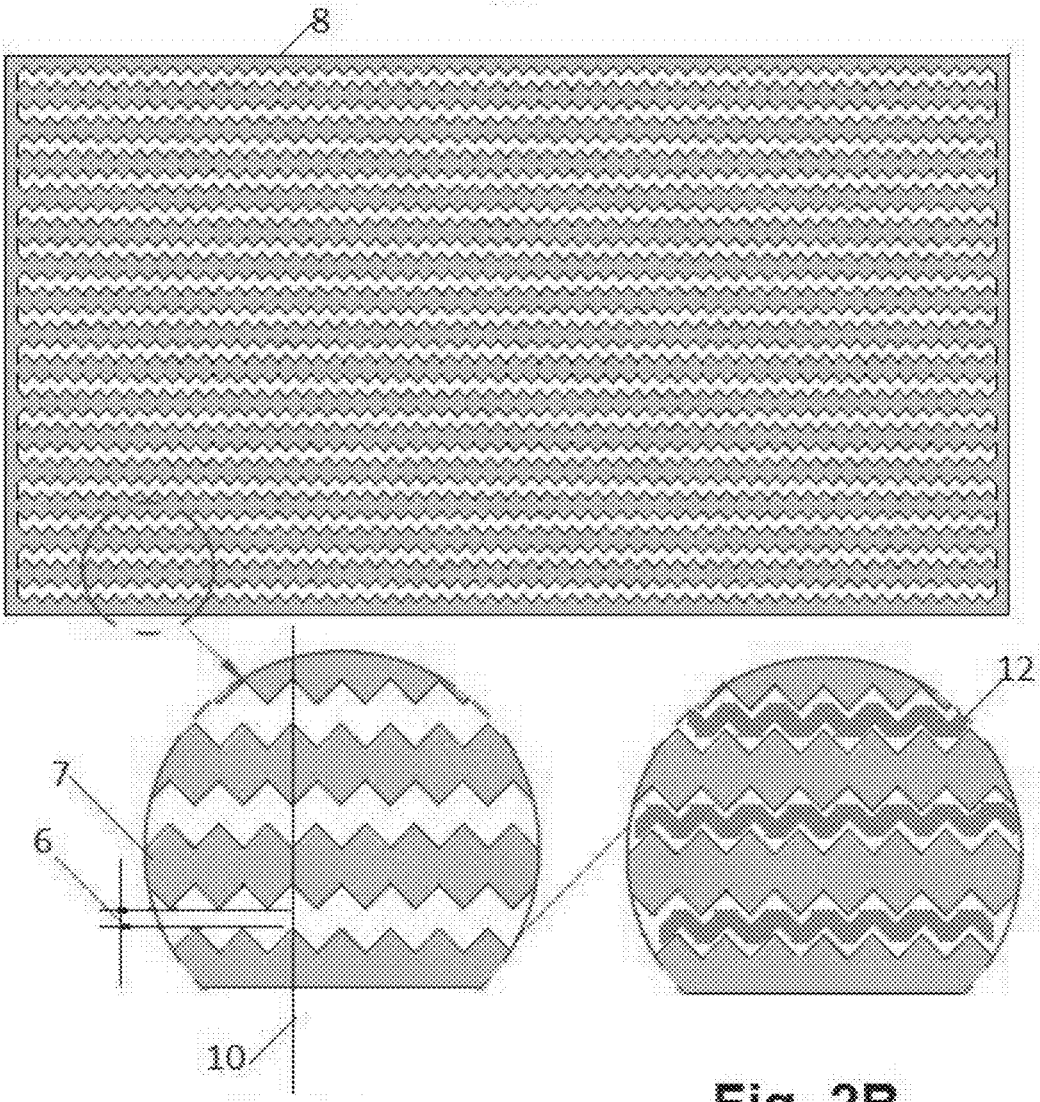
FIG. 2—a magnetic matrix according to the present invention.
FIG. 2A—an enlarged detail view of a magnetic matrix of FIG. 2.
FIG. 2B—an enlarged detail view of the magnetic matrix of FIG. 2 with a flattened expanded sheet disposed between the plates.

FIG. 2 shows a magnetic matrix 8 according to the present invention constructed with grooved plates 7, which can be seen more clearly in the detail of FIG. 2A. Line 10 indicates the alignment of the ridge of a plate with the valley of the adjacent plate, characterizing the ridge-valley configuration. This type of assembly of the grooved plates 7 allows the insertion between two adjacent plates of a corrugated expanded sheet 12, preferably of steel, which efficiently fills the space of the grooves, as shown in the enlarged detail view 2B.

Comparing FIG. 1B with FIG. 2B, it can be seen that the corrugated expanded sheet 12 has a total extent up to 41% greater than the length extension of the flattened expanded sheet 5. This increase in length can be confirmed by the fact that the overall width of the corrugated expanded sheet 12 is formed by the sum of the sides of the isosceles rectangular triangles that enter the grooves one by one while the length of the flat expanded sheet is equal to the sum of the bases of these triangles. The geometric relationship indicates that the sum of the sides of these triangles is 1.41 times the length of the bases.

This configuration of the corrugated expanded steel sheet 12 which allows this increase in length is one of the main factors to increase the production of the corrugated magnetic matrix, since this increase in length directly results in the increase of the collecting surface of the magnetic microparticles.

Figures 3, 3A, 3B:
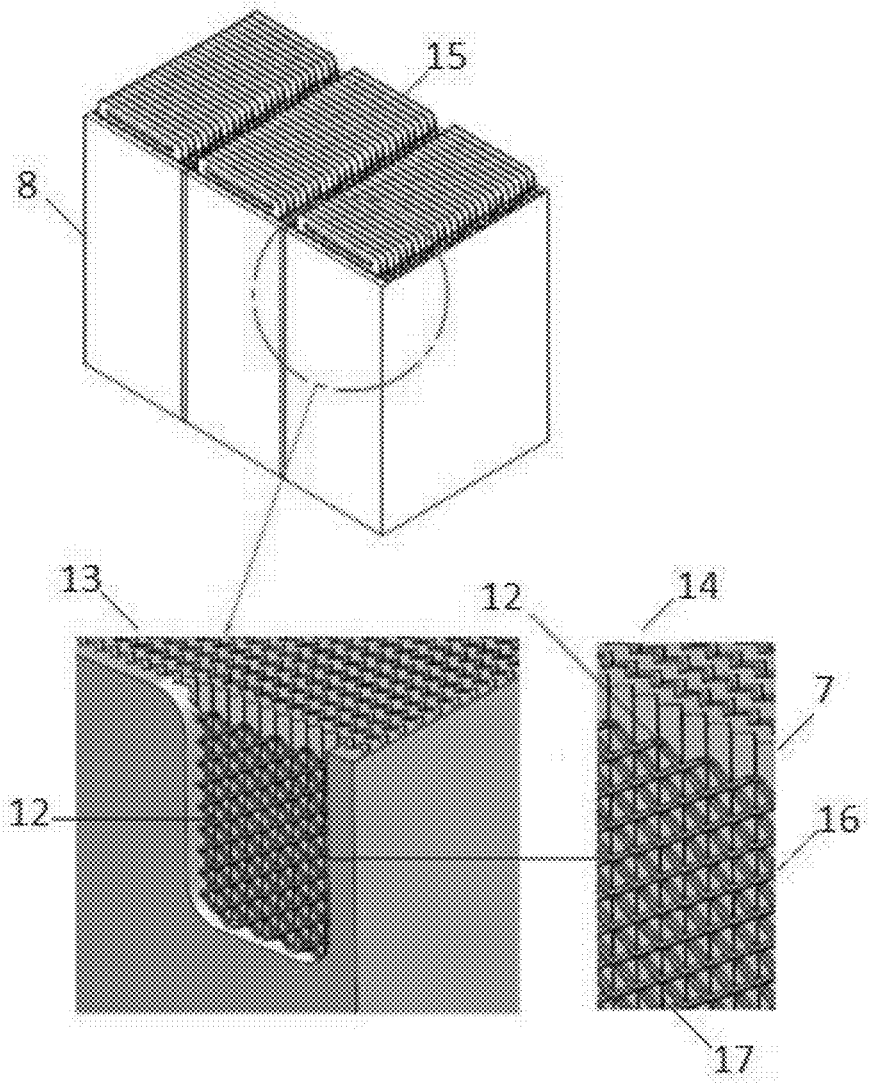
FIG. 3—a perspective view of the magnetic matrix according to the present invention.
FIG. 3A—an enlarged detail view of a magnetic matrix of FIG. 3, without a portion of the outer housing of the matrix, and showing its interior.
FIG. 3B—an enlarged detail view of the grooved plates with corrugated web plate grooves within the matrix of FIG. 3.

FIG. 3 shows a perspective view of the magnetic matrix 8 according to the present invention with the grooved plates 7 in the ridge-valley arrangement and the corrugated sheets 12 disposed therebetween. That embodiment of the invention which is most clearly illustrated in the enlarged detail views of FIG. 3A, showing the matrix without a portion of its outer housing for viewing the plates and sheets therein, and FIG. 3B shows in detail the interior of the matrix. The corrugated sheets consist of a number of corrugated or zigzag threads 16 forming a corrugated expanded web. Such corrugated webs 12 have, at their corners, collecting edges 17 which are also responsible for the generation of the magnetic gradient responsible for the attraction of the magnetic microparticles. Such corrugated web sheets 12 are also inserted between the grooved plates.

As can be seen in FIG. 3, for handling the corrugated expanded sheets 12, handles 15 are available at their upper ends, through which the corrugated sheets 12 can be moved up and down both at the times of installation and removal of the corrugated sheets 12, as in the cleaning moments of the grooved plates.

Figure 4:
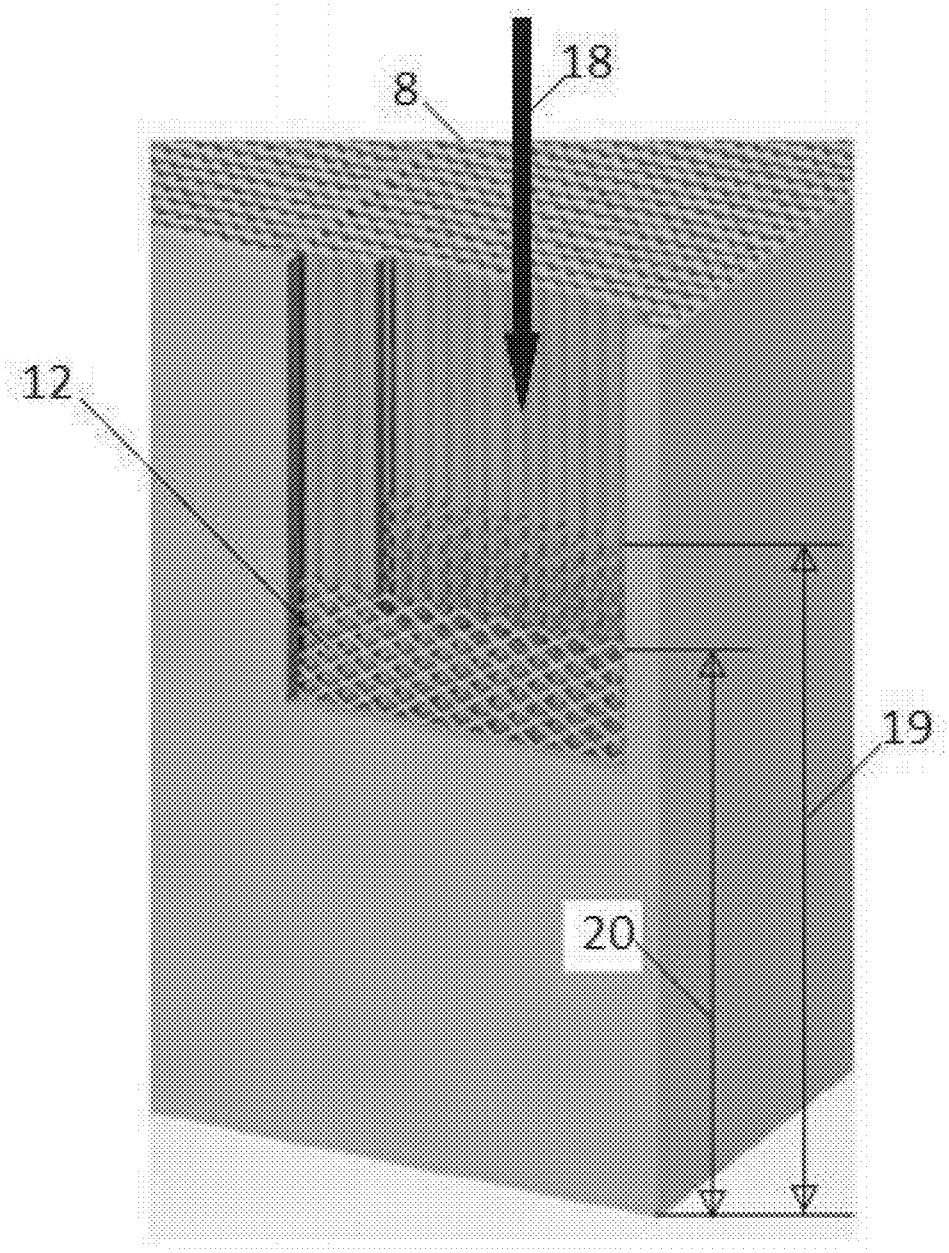
FIG. 4—a view of the magnetic matrix with cuts in varying planes, showing the arrangement of the grooved plates and the corrugated web plates.

FIG. 4 depicts a cross-sectional view of the magnetic matrix 8 with the ridge-valley configuration shown in cross-section in varying planes, so that the corrugated sheets 12 with variable heights can be viewed, with a higher height 19 and a lower height 20. The flow of pulp being fed is represented by arrow 18. By choosing the appropriate height of the corrugated expanded sheet 12, it is possible to adjust the hydraulic pressure loss to define the pulp flow rate, and also to correctly adjust the residence time of the pulp within the separator matrices to the specific characteristics of the mineral being processed.

Figure 5:
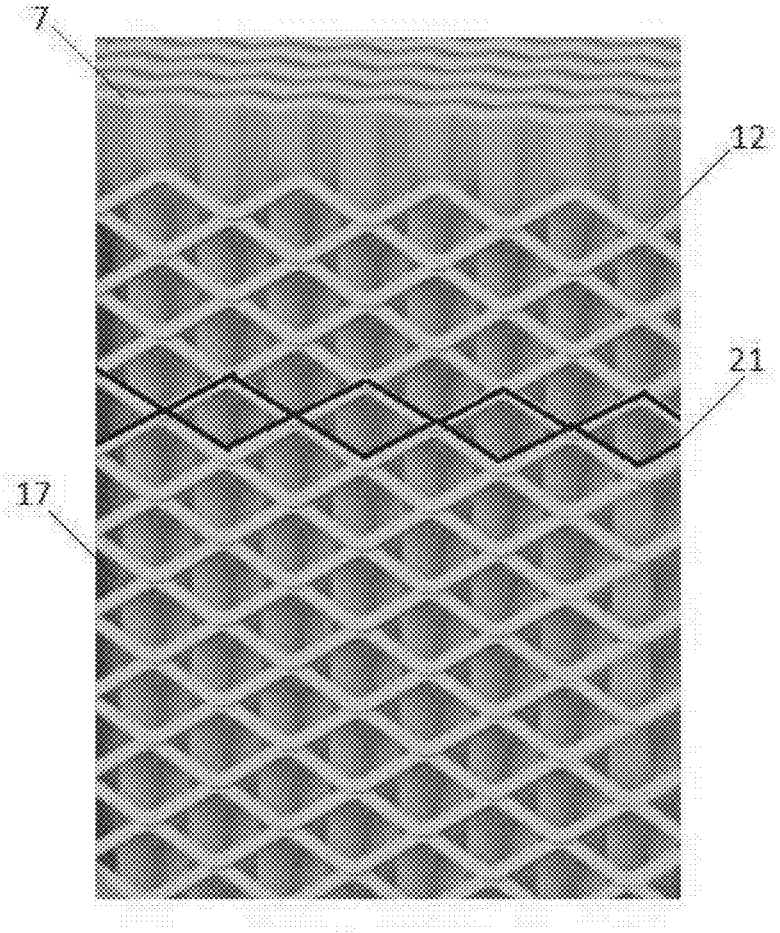
FIG. 5—a detail view of the corrugated expanded web plate in front of the grooved plate.

FIG. 5 shows the corrugated expanded sheet 12 in front of the grooved plate 7. Some collecting edges 17 highlighted in bold 21 indicate the length of the lines where the magnetic particles are collected in order to better clarify the effect that the increased length of the corrugated expanded sheet has on increasing production.

The modifications described herein applied to this type of corrugated magnetic matrix also provide three features that improve the magnetic separation process, namely:

1. The presence of the sheet between the matrices allows to reduce the rate of the separating pulp, reducing, therefore, the hydrodynamic drag that the contained water exerts on the microparticles. Reduced rate is a key factor so that the microparticles have sufficient time to be collected at the edges formed by the corrugated expanded sheet fillets.

2. The corrugated shape and the multiplicity of edges of the corrugated expanded sheet allows for a substantial increase in the collection points of the microparticles, enhancing the bulk recovery of the salable product. This prolongation of the fillet collecting edges together with the pulp speed reduction and the generation of high magnetic gradients add up to maximize recovery and the quality of the magnetic product.

3. Since the grooved plates are aligned in the ridge-valley form, and because of the corrugated shape of the expanded sheets which are inserted between the channels formed by the opposed grooved plates, being intermeshed therebetween, that arrangement forms a sandwich, allowing, in case of clogging of the channels for any reason, the rapid elimination of obstruction simply by removing these corrugated steel screens from within the matrix channels.

Removing the screen drags away the materials that are causing the clogging. The removed screen can then be cleaned and easily repositioned in the original position, thus completing the unclogging process. In this way, there is no need to use other cleaning equipment for the small space between the grooved plates, since these corrugated expanded sheets serve as a natural tool to clean the grooves in case of clogging.

In addition, this corrugated magnetic matrix has such a structure that, when subjected to the field of the magnetic separator, enables one to obtain by induction magnetic inductions within the range of up to 18,000 Gauss with magnetic gradients up to 4000 Gauss/mm, significantly increasing its ability to extract ultrafine particles from the ore being processed. This is because corrugated expanded sheets contribute to increase the value of the magnetic field within the matrix.

The combined operation of all of these described features add together to provide the high performance, productivity and ease of operation of the corrugated magnetic matrix object of this invention.

The example described above represents a preferred embodiment; however, it should be understood that the scope of the present invention encompasses other possible variations, and is limited only by the content of the appended claims, which include all possible equivalents.

What is claimed is:

1. A magnetic matrix for high intensity magnetic separator which is fed with a pulp containing magnetic and non-magnetic particles, the magnetic matrix comprising:

a series of metal plates grooved on their two faces, the grooved plates being arranged in a row, parallel to and spaced apart from each other from the same spacing within a housing, wherein each face of each grooved metal plate has the ridges aligned with the valleys of the face facing it of the adjacent grooved metal plate; and a corrugated expanded sheet disposed in the spacing between adjacent grooved plates with the corrugations of the corrugated expanded sheets corresponding to the ridge-valley alignments of the respective adjacent grooved plates.

2. The magnetic matrix for high intensity magnetic separator according to claim 1, wherein one of the corrugated expanded sheets has a different height than another one of the corrugated expanded sheets, and the height of each of the corrugated expanded sheets is less than or equal to the height of the grooved plates.

3. The magnetic matrix for high intensity magnetic separator according to claim 2, wherein the height of each corrugated expanded sheet is selected as a function of at least one of a hydraulic load of the pulp, a flow speed of the pulp, and a residence time of the pulp within the matrix.

4. The magnetic matrix for high intensity magnetic separator according to claim 1, wherein each corrugated expanded sheet has a handle on its upper end.

5. The magnetic matrix for high intensity magnetic separator according to claim 2, wherein each corrugated expanded sheet has a handle on its upper end.

6. The magnetic matrix for high intensity magnetic separator according to claim 3, wherein each corrugated expanded sheet has a handle on its upper end.

* * * * *